US009172137B2

(12) United States Patent
Lee et al.

(10) Patent No.: US 9,172,137 B2
(45) Date of Patent: Oct. 27, 2015

(54) ADJUSTING MECHANISM AND RELATED ANTENNA SYSTEM

(75) Inventors: Ming-Chan Lee, Hsinchu (TW); Lan-Chun Yang, Hsinchu (TW); Hung-Yuan Lin, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 434 days.

(21) Appl. No.: 13/409,070

(22) Filed: Feb. 29, 2012

(65) Prior Publication Data

US 2013/0134271 A1 May 30, 2013

(30) Foreign Application Priority Data

Nov. 29, 2011 (CN) ..... 100143699

(51) Int. Cl.

| | |
|---|---|
| ***A47B 96/06*** | (2006.01) |
| ***F21V 35/00*** | (2006.01) |
| ***H01Q 3/06*** | (2006.01) |
| ***H01Q 1/12*** | (2006.01) |

(52) U.S. Cl.

CPC . *H01Q 3/06* (2013.01); *H01Q 1/125* (2013.01)

(58) Field of Classification Search

CPC ..... H01Q 1/12; H01Q 1/125; H01Q 1/1228; H01Q 3/02; H01Q 3/08; H01Q 1/1207; H01Q 1/3275; H01Q 1/1221; H01Q 1/1264; H01Q 1/3258; H01Q 3/04

USPC ..... 248/205.1, 218.4, 222.51, 122.1, 371, 248/272.1, 419, 284.1, 291.1, 292.11, 248/292.13, 219.2, 285.1, 286.1, 287.1, 248/279.1; 343/878, 880, 882, 892, 765, 343/757

See application file for complete search history.

(56) References Cited

U.S. PATENT DOCUMENTS

| | | | | | |
|---|---|---|---|---|---|
| 4,652,890 | A * | 3/1987 | Crean | ..... | 343/882 |
| 4,819,006 | A * | 4/1989 | Whitesides et al. | ..... | 343/880 |
| 5,075,682 | A * | 12/1991 | Dehnert | ..... | 342/352 |
| 5,198,830 | A * | 3/1993 | Lin | ..... | 343/882 |
| 5,445,355 | A * | 8/1995 | Chen | ..... | 248/514 |
| 5,751,548 | A * | 5/1998 | Hall et al. | ..... | 361/679.41 |
| 5,969,692 | A * | 10/1999 | Ishizuka | ..... | 343/840 |
| 6,404,400 | B1 * | 6/2002 | Tulloch | ..... | 343/765 |
| 6,535,177 | B1 * | 3/2003 | Dhellemmes et al. | ..... | 343/882 |

(Continued)

FOREIGN PATENT DOCUMENTS

| | | | | | |
|---|---|---|---|---|---|
| JP | 59015306 | A * | 1/1984 | ..... | H01Q 1/12 |
| JP | 59015307 | A * | 1/1984 | ..... | H01Q 1/12 |

(Continued)

*Primary Examiner* — Kimberly Wood

(74) *Attorney, Agent, or Firm* — Winston Hsu; Scott Margo

(57) ABSTRACT

An adjusting mechanism includes a supporter, a foundation and a clamper. The supporter includes a base, and a supporting component pivotably disposed on the base along a first axial direction. An open hole is formed on a bottom of the base, and the base includes a fixing portion. The foundation is pivotably disposed on the base. A conjunction portion is disposed on a surface of the foundation, and the fixing portion is connected to the conjunction portion for preventing the base from rotating relative to the foundation. The clamper is fixed on the foundation for piercing through the open hole and partly positioning between the base and the supporting component. The clamper includes a body for clamping a tube, and two connecting parts disposed on a lateral surface of the body. A direction of each connecting part is parallel to a second axial direction perpendicular to the first axial direction.

16 Claims, 8 Drawing Sheets

(56) References Cited

U.S. PATENT DOCUMENTS

| | | | | |
|---|---|---|---|---|
| 6,864,855 | B1 * | 3/2005 | Fujita | 343/882 |
| 6,873,304 | B1 * | 3/2005 | Malhotra | 343/890 |
| 6,932,307 | B2 * | 8/2005 | Guennec et al. | 248/219.2 |
| 6,963,316 | B1 * | 11/2005 | Lin | 343/882 |
| 7,050,012 | B2 * | 5/2006 | Chen | 343/757 |
| 7,113,144 | B2 * | 9/2006 | Lin et al. | 343/880 |
| 7,164,391 | B2 * | 1/2007 | Lin et al. | 343/882 |
| 7,265,732 | B2 * | 9/2007 | Lin | 343/882 |
| 7,408,526 | B2 * | 8/2008 | Pan | 343/880 |
| 7,880,682 | B2 * | 2/2011 | Fruh et al. | 343/757 |
| 8,020,824 | B2 * | 9/2011 | Pan | 248/299.1 |
| 8,052,107 | B2 * | 11/2011 | Yang et al. | 248/201 |
| 2005/0057428 | A1 * | 3/2005 | Fujita | 343/882 |
| 2006/0231693 | A1 * | 10/2006 | Lin et al. | 248/121 |
| 2007/0177064 | A1 * | 8/2007 | Lin et al. | 348/838 |
| 2008/0150831 | A1 * | 6/2008 | Tulloch | 343/882 |
| 2008/0165076 | A1 * | 7/2008 | Pan | 343/882 |
| 2009/0061761 | A1 * | 3/2009 | Yang et al. | 455/3.02 |
| 2009/0262033 | A1 * | 10/2009 | King et al. | 343/713 |
| 2010/0156751 | A1 * | 6/2010 | Yang et al. | 343/882 |
| 2010/0259462 | A1 * | 10/2010 | Yeh | 343/882 |
| 2011/0031360 | A1 * | 2/2011 | Pan | 248/201 |

FOREIGN PATENT DOCUMENTS

| | | | | |
|---|---|---|---|---|
| JP | 60090403 | A * | 5/1985 | H01Q 1/12 |
| JP | 60253304 | A * | 12/1985 | H01Q 1/12 |
| TW | 555170 | | 9/2003 | |
| TW | M312024 | | 5/2007 | |

* cited by examiner

ADJUSTING MECHANISM AND RELATED ANTENNA SYSTEM

BACKGROUND OF THE INVENTION

1. Field of the Invention

The present invention relates to an adjusting mechanism and a related antenna system, and more particularly, to a small-size adjusting mechanism that has preferable structural strength and a related antenna system.

2. Description of the Prior Art

For receiving signals generated by a satellite effectively, an antenna module includes an adjusting mechanism for adjusting rotary angle of the antenna module according to a position of the satellite relative to the ground. A conventional adjusting mechanism for adjusting an elevation and an azimuth of the antenna module relative to the satellite includes a sheath and a rotating structure. The sheath sheathes on a supporting tube, and the rotating structure is disposed on an end of the sheath (for example, the rotating structure is disposed on top of the sheath), so that the conventional adjusting mechanism can adjust the elevation and the azimuth of the antenna module relative to the supporting tube and the satellite. However, volume of the conventional adjusting mechanism is huge. For example, a height of the conventional adjusting mechanism is the total amount of heights of the sheath and the rotating structure. The conventional adjusting mechanism has drawbacks of expensive manufacturing cost, expensive transportation cost and complicated assembly. Thus, design of an adjusting mechanism with simple structure that has low transportation cost and low manufacturing cost is an important issue of the antenna industry.

SUMMARY OF THE INVENTION

The present invention provides a small-size adjusting mechanism that has preferable structural strength and a related antenna system for solving above drawbacks.

According to the claimed invention, an adjusting mechanism includes a supporter for supporting an antenna module. The supporter includes a base, and a supporting component pivotably disposed on the base in a manner of surrounding a first axial direction, so as to adjust an elevation angle of the antenna module. An open hole is formed on a bottom of the base, and the base includes a fixing portion. The adjusting mechanism further includes a foundation pivotably disposed on the base in a manner of surrounding a third axial direction different from the first axial direction, so as to adjust an azimuth angle of the antenna module. A conjunction portion is disposed on a surface of the foundation, and the fixing portion is connected to the conjunction portion for preventing the base from rotating relative to the foundation. The adjusting mechanism further includes a clamper fixed on the foundation. The clamper pierces through the open hole on the base and is partly accommodated between the base and the supporting component. The clamper includes a circular body for clamping a tube, and two connecting parts disposed on lateral surfaces of the circular body. The circular body is fixed on the tube via the connecting parts, and a direction of each connecting part is substantially parallel to a second axial direction perpendicular to the first axial direction.

According to the claimed invention, the fixing portion is a hook, and the conjunction portion is a guiding slot. The hook is slidably buckled inside the guiding slot, so as to constrain a movement of the base relative to the foundation along the third axial direction perpendicular to the first axial direction and the second axial direction.

According to the claimed invention, the fixing portion is an element whereon a lock hole is formed, and the conjunction portion is a guiding slot. The adjusting mechanism further includes a fixing component. The fixing component pierces through the guiding slot and the lock hole on the element, so as to constrain a movement of the base relative to the foundation along the third axial direction perpendicular to the first axial direction and the second axial direction.

According to the claimed invention, an interval height between a bottom of the connecting part and a surface of the foundation is substantially greater than a thickness of the base.

According to the claimed invention, the open hole includes a first area and a second area. A dimension of the first area corresponds to a dimension of the circular body, and a dimension of the second area corresponds to dimensions of the connecting parts.

According to the claimed invention, the base includes a bottom portion, a first lateral portion and a second lateral portion. The first lateral portion and the second lateral portion are respectively disposed on two edges of the bottom portion and movably connected to the supporting component, and a part of the clamper is accommodated between the first lateral portion and the second lateral portion.

According to the claimed invention, superficial measure of the first lateral portion is substantially smaller than superficial measure of the second lateral portion, so as to expose the connecting part of the clamper.

According to the claimed invention, the adjusting mechanism includes a plurality of rib structures. The rib structures are respectively disposed on surfaces of the base, the supporting component and the foundation.

According to the claimed invention, a contacting portion is disposed on a top of the clamper for constraining a movement of the clamper relative to the tube.

According to the claimed invention, an antenna system includes an antenna module, a tube, and an adjusting mechanism disposed between the antenna module and the tube for adjusting angles of the antenna module relative to the tube. The adjusting mechanism includes a supporter for supporting an antenna module. The supporter includes a base, and a supporting component pivotably disposed on the base in a manner of surrounding a first axial direction, so as to adjust an elevation angle of the antenna module. An open hole is formed on a bottom of the base, and the base includes a fixing portion. The adjusting mechanism further includes a foundation pivotably disposed on the base in a manner of surrounding a third axial direction different from the first axial direction, so as to adjust an azimuth angle of the antenna module. A conjunction portion is disposed on a surface of the foundation, and the fixing portion is connected to the conjunction portion for preventing the base from rotating relative to the foundation. The adjusting mechanism further includes a clamper fixed on the foundation. The clamper pierces through the open hole on the base and is partly accommodated between the base and the supporting component. The clamper includes a circular body for clamping a tube, and two connecting parts disposed on lateral surfaces of the circular body. The circular body is fixed on the tube via the connecting parts, and a direction of each connecting part is substantially parallel to a second axial direction perpendicular to the first axial direction.

The present invention disposes the clamper inside the base for reducing the structural height of the adjusting mechanism, so that the dimensions of the adjusting mechanism and the antenna system are decreased, and the manufacturing cost and the transportation cost can be decreased accordingly. The open hole can be formed on the bottom portion of the base, and the shape and the dimension of the open hole can correspond to the shape and the dimension of the clamper for easy assembly of the clamper and the base. In addition, the interval height between the connecting part and the foundation can prevent the bottom portion from being interfered with the connecting parts when the clamper is welded on the foundation, so the base of the present invention can rotate relative to the foundation unrestrainedly. The direction of the connecting parts of the present invention can be substantially parallel to the second axial direction, and the user can fix the locking components on the connecting parts (or remove the locking components from the connecting parts) through the gap between each connecting part and the adjacent lateral portion. Furthermore, the part of the lateral portion of the base can be segmented, so the user can utilize the screw driver to lock and to remove the locking components from the connecting parts due to difference of the superficial measures between the first lateral portion and the second lateral portion.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
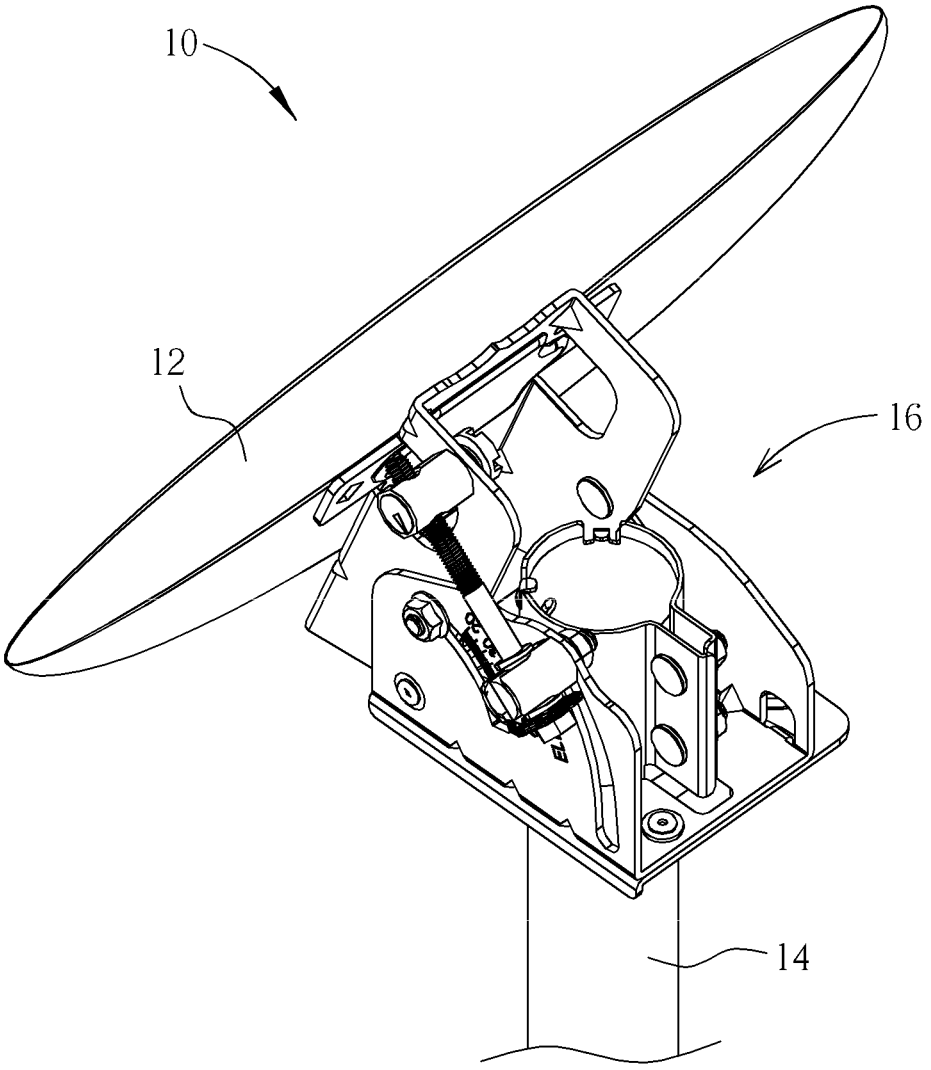
FIG. 1 is a diagram of an antenna system according to a first embodiment of the present invention.
Figure 2:
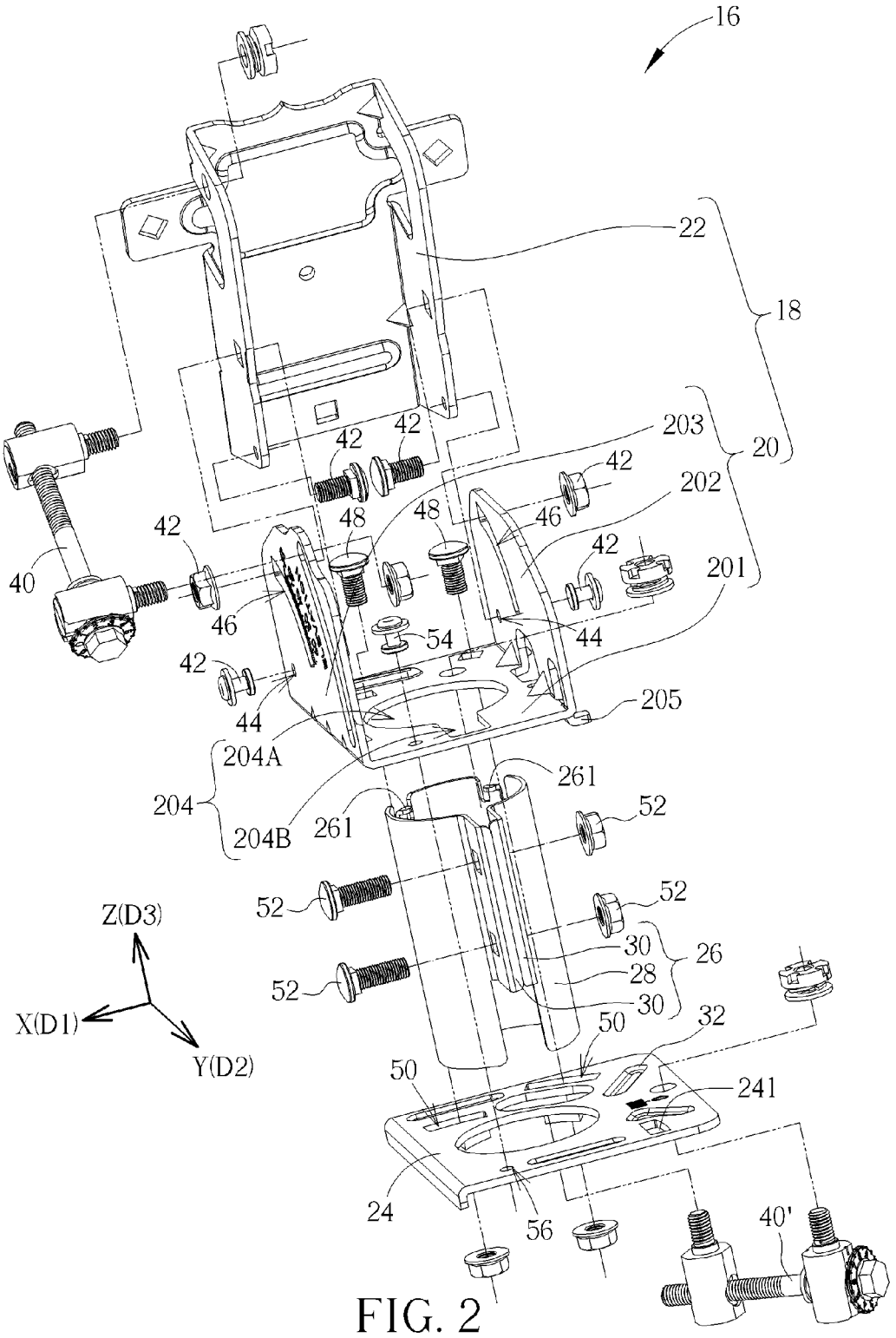
FIG. 2 is an exploded diagram of an adjusting mechanism according to the first embodiment of the present invention.

Please refer to FIG. 1. FIG. 1 is a diagram of an antenna system 10 according to a first embodiment of the present invention. The antenna system 10 includes an antenna module 12, a tube 14 and an adjusting mechanism 16. The adjusting mechanism 16 is disposed between the antenna module 12 and the tube 14 for adjusting angles of the antenna module 12 relative to the tube 14 for position adjustment, and the angles can be an elevation angle and an azimuth angle. Please refer to FIG. 2. FIG. 2 is an exploded diagram of the adjusting mechanism 16 according to the first embodiment of the present invention. Volume of the adjusting mechanism 16 can be reduced by specific structural design.

As shown in FIG. 2, the adjusting mechanism 16 includes a supporter 18 for supporting the antenna module 12. The supporter 18 includes a base 20 and a supporter component 22. The base 20 includes a bottom portion 201, a first lateral portion 202 and a second lateral portion 203. The first lateral portion 202 and the second lateral portion 203 are respectively disposed on two opposite edges of the bottom portion 201, so that the base 20 can be a U-shaped structure. The supporting component 22 can be movably connected to the first lateral portion 202 and the second lateral portion 203 via assembly of connecting units 42, connecting holes 44 and connecting slots 46, which means the supporting component 22 can be pivotably disposed on the base 20 in a manner of surrounding a first axial direction D1 (X axis). For example, the supporting component 22 is rotatably disposed on the base 20 by the connecting units 42 attached to the connecting holes 44, and the supporting component 22 can slide relative to the base 20 according to paths of the connecting units 42 within the connecting slots 46. The adjusting mechanism 16 can utilize a screw set 40 disposed between the base 20 and the supporting component 22 to pivot the supporting component 22 relative to the base 20 along an YZ plane, so as to adjust the elevation angle of the antenna module 12. An end of the screw set 40 is rotatably disposed on the supporting component 22, and the other end of the screw set 40 is slidably disposed within the connecting slot 46 on the base 20. In addition, an open hole 204 is formed on the bottom portion 201 of the base 20, and the base 20 further includes a fixing portion 205. The fixing portion 205 is disposed on a border between the bottom portion 201 and the first lateral portion 202 (or the second lateral portion 203).

The adjusting mechanism 16 further includes a foundation 24 pivotably disposed on the base 20 via assembly of sliding units 48 and sliding holes 50 and assembly of a fastener 54 and an opening 56, and a clamper 26 fixed on the foundation 24 and installed on the tube 14. The base 20 is rotatably disposed on the foundation 24 by the fastener 54 and the opening 56, and the base 20 can slide relative to the foundation 24 according to paths of the sliding units 48 within the sliding holes 50. The adjusting mechanism 16 can utilize the other screw set 40' disposed between the base 20 and the foundation 24 to rotate the base 20 relative to the foundation 24 along an XY plane, so as to adjust the azimuth angle of the antenna module 12. Ends of the screw set 40' are rotatably disposed on the foundation 24 and the base 20, respectively. A plurality of contacting portions 261 can be disposed on a top of the clamper 26. The contacting portions 261 can contact against the tube 14 when the clamper 26 is completely installed on the tube 14, so as to constrain a movement of the clamper 26 relative to the tube 14. Meanwhile, the clamper 26 can be locked on the tube 14 and cannot move relative to the tube 14. Because the clamper 26 can be fixed on the foundation 24 by weld, the foundation 24 does not move relative to the clamper 26 and the tube 14. The base 20 of the supporter 18 can rotate relative to the foundation 24 for adjusting the azimuth angle of the antenna module 12 relative to the tube 14. In addition, a conjunction portion 241 is disposed on a surface of the foundation 24. The conjunction portion 241 can be connected to the fixing portion 205, so as to prevent the base 20 from rotating relative to the foundation 24.

Figure 3:
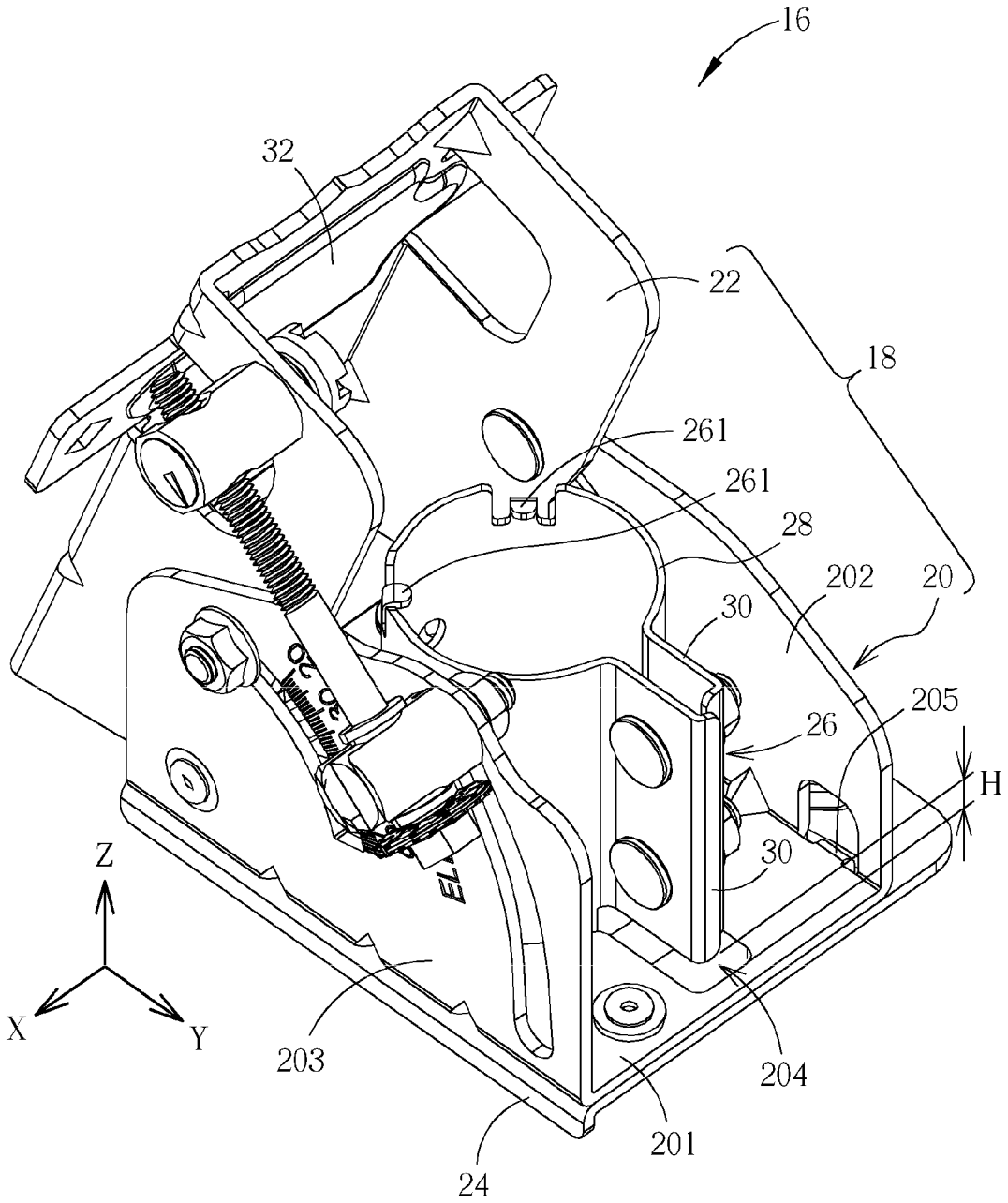
FIG. 3 is an assembly diagram of the adjusting mechanism according to the first embodiment of the present invention.

Please refer to FIG. 2 and FIG. 3. FIG. 3 is an assembly diagram of the adjusting mechanism 16 according to the first embodiment of the present invention. For reducing the volume of the adjusting mechanism 16, the clamp 26 can pass through the open hole 204 on the base 20, and be partly accommodated between the base 20 and the supporting component 22 (which means the clamper 26 is partly accommodated between the bottom portion 201, the first lateral portion 202 and the second lateral portion 302 of the base 20). The clamper 26 includes a circular body 28 for clamping the tube 14, and two connecting parts 30 disposed on lateral surfaces of the circular body 28. As the circular body 28 clamps the tube 14, the connecting parts 30 can be engaged with each other via a plurality of locking components (such as a screw or a bolt), so that the circular body 28 can wrap around the tube 14 tightly.

As shown in FIG. 2, the open hole 204 includes a first area 204A and a second area 204B. The first area 204A can be a circular hole, a dimension and a shape of the circular hole can be substantially equal to (and slightly greater than) a dimension and a shape of the circular body 28 of the clamper 26. The second area 204B can be a rectangular hole, a dimension and a shape of the rectangular hole can be substantially correspond to and slightly greater than a dimension and a shape of the connecting parts 30 of the clamper 26, so the clamper 26 can easily pass through the open hole 204 on the base 20. As shown in FIG. 3, the circular body 28 and the connecting parts 30 can be partly located above an upper surface of the foundation 24 when the base 20 is installed on the clamper 26, and a part of the clamper 26 can be accommodated between the first lateral portion 202 and the second lateral portion 203, so that the structural height of the adjusting mechanism 16 of the present invention can be decreased effectively.

It should be mentioned that the maximum elevation angle of the supporting component 22 of the present invention can be set as 65 degrees. A length of the part of the circular body 28 located above the upper surface of the foundation 24 can be designed that is not interfered with maximum rotation of the supporting component 22 of the present invention, which means an inner surface of the supporting component 22 does not contact the top of the circular body 28 when the supporting component 22 rotates relative to the base 20 in a range from 20 degree to 65 degrees, so that the supporting component 22 can rotate arbitrarily within the predetermined range of the elevation angle (from 20 degree to 65 degrees). A radial dimension of the circular body 28 can be designed according to dimensions of the tube 14, a length of the part of the circular body 28 located above the upper surface of the foundation 24 corresponds to dimensions of the base 20 and the supporting component 22 of the supporter 18, and detail description is omitted herein for simplicity. Besides, a direction of each connecting part 30 can be substantially parallel to a second axial direction D2 (Y axis) perpendicular to the first axial direction D1 (X axis), and a user can fix the screw on the connecting parts 30 conveniently through a gap between the connecting parts 30 inside the base 20 and the adjacent first lateral portion 202 and the adjacent second lateral portion 203.

Figure 4:
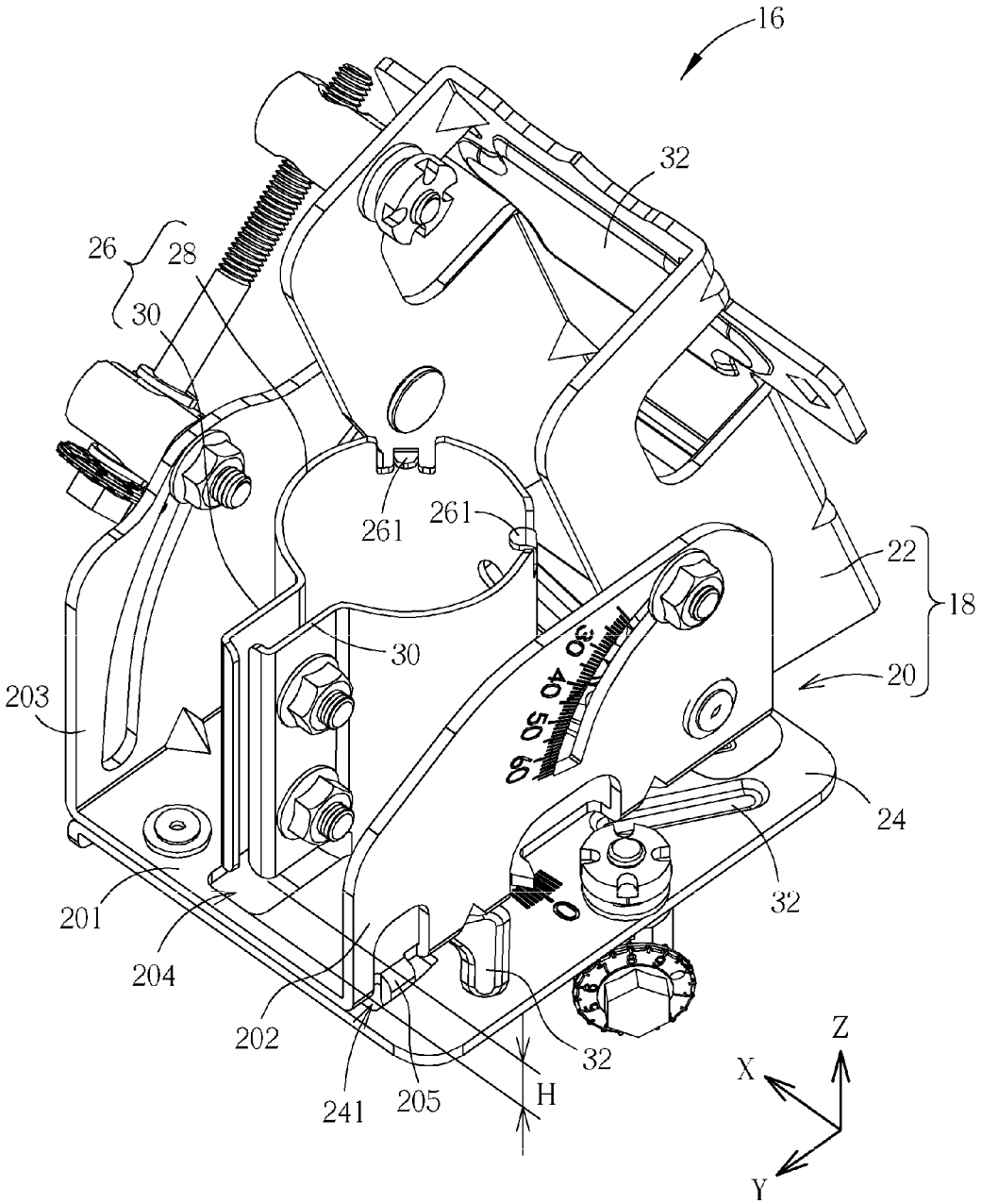
FIG. 4 and FIG. 5 are diagrams of the adjusting mechanism in different view angles according to the first embodiment of the present invention.
Figure 5:
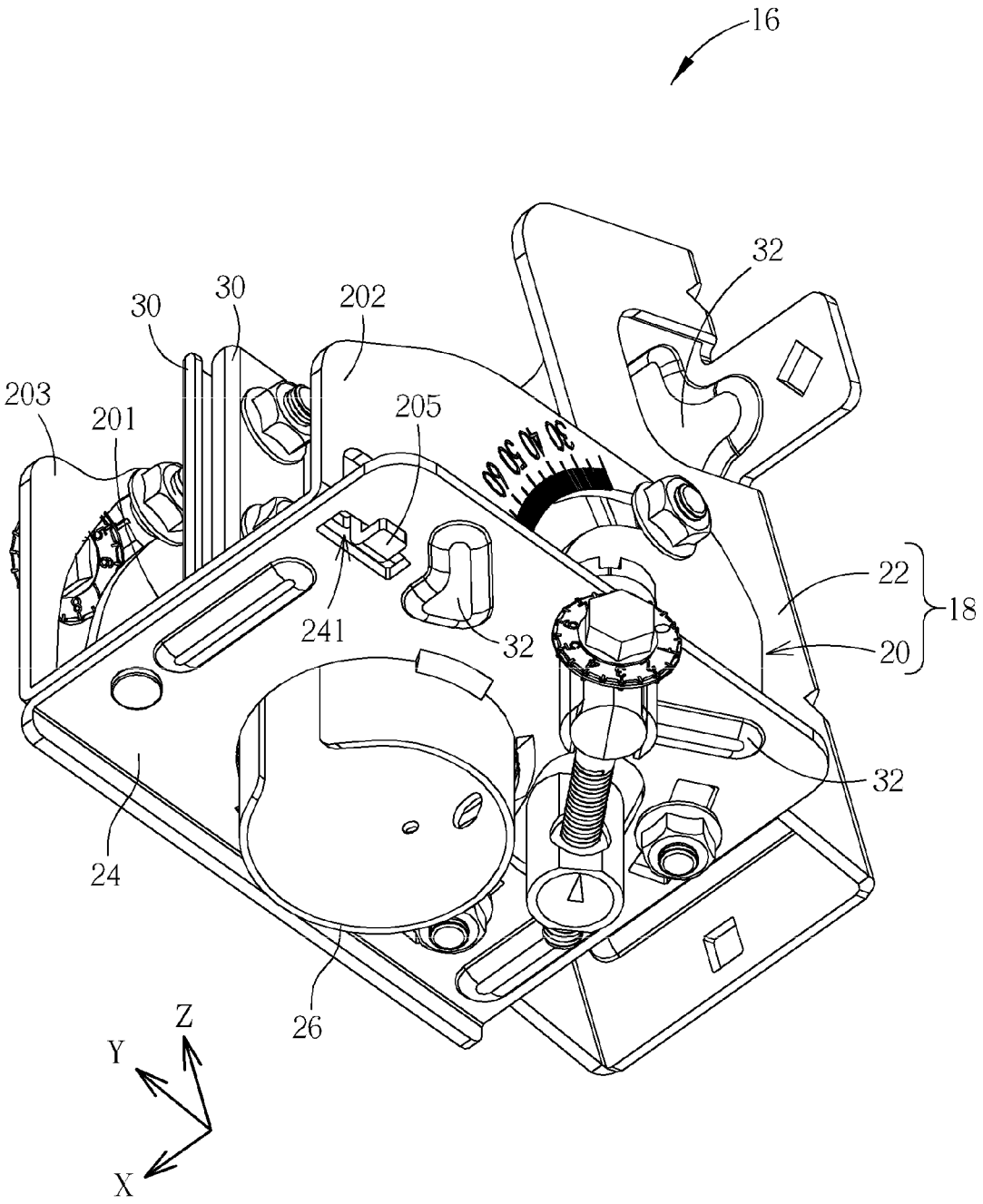

Please refer to FIG. 2 to FIG. 5. FIG. 4 and FIG. 5 are diagrams of the adjusting mechanism 16 in different view angles according to the first embodiment of the present invention. An interval height H between a bottom of each connecting part 30 and a surface of the foundation 24 can be substantially greater than a thickness of the base 20 (a thickness of bottom portion 201). The base 20 can rotate relative to the foundation 24 arbitrarily, and is not interfered due to the connecting parts 30 and the foundation 24. The clamper 26 can be a nipper for tightly gripping the tube 14. An amount of the locking components for the nipper is not limited to the above-mentioned embodiment, and depends on structural design demand. In the present invention, the clamper 26 passes through the open hole 204 on the base 20 and is partly accommodated between the base 20 and the supporting component 22, so that the structural length of the adjusting mechanism 16 can be decreased effectively. In addition, a plurality of rib structures 32 can be disposed on surfaces of the base 20, the supporting component 22 and the foundation 24 selectively. Dimensions of the base 20, the supporting component 22 and the foundation 24 can be reduced, and structural strength of the base 20, the supporting component 22 and the foundation 24 keep as original due to the rib structures 32, so the structural volume of the adjusting mechanism 16 can be decreased accordingly, and manufacturing cost and transportation cost of the adjusting mechanism 16 of the present invention can be economized.

For improving operation convenience of the present invention, directions of the connecting parts 30 of the clamper 26 can be substantially parallel to the second axial direction D2 (Y axis), so the gap between each connecting part 30 and the adjacent lateral portion (the first lateral portion 202 and the second lateral portion 203) can have spacious size. The user can utilize the locking components 52 to fix on the connecting parts 30 (or to remove the locking components from the connecting parts 30) through the gap. As shown in FIG. 2 to FIG. 5, the fixing portion 205 of the base 20 can be a hook, the conjunction portion 241 of the foundation 24 can be a guiding slot, and the hook can be slidably disposed inside the guiding slot, so as to complete an assembly of the fixing portion 205 and the conjunction portion 241. The assembly of the fixing portion 205 and the conjunction portion 241 can prevent the base 20 from rotating relative to the foundation 24.

For example, the bottom portion 201 can be connected to the foundation 24 via a mounting portion and two sliding portions. The base 20 can utilize the mounting portion to be a pivot to rotate relative to the foundation 24 for adjusting the azimuth angle of the antenna module 12. Generally, the foundation 24 and the bottom portion 201 can be designed as rectangular structures, the mounting portion and the sliding portions are respectively disposed on three corners of each rectangular structure, and the assembly of the fixing portion 205 and the conjunction portion 241 can be respectively disposed on the fourth corner, which is different from the corners whereon the mounting portion and the sliding portions are disposed, of the rectangular structure. As the fixing portion 205 is not connected to the conjunction portion 241, and a weight of the antenna module 12 exceeds a load of the mounting portion and the sliding portions, the bottom portion 201 may be overturned relative to the foundation 24 at the fourth corner. Therefore, the four corners of the bottom portion 201 and the foundation 24 can be firmly fixed by the assembly of the mounting portion and the sliding portions and by the assembly of the fixing portion 205 and the conjunction portion 241, so as to constrain a movement of the base 20 relative to the foundation 24 along a third axial direction D3 (Z axis) perpendicular to the first axial direction D1 (X axis) and the second axial direction D2 (Y axis) for increasing operation stability of the adjusting mechanism 16.

Figure 6:
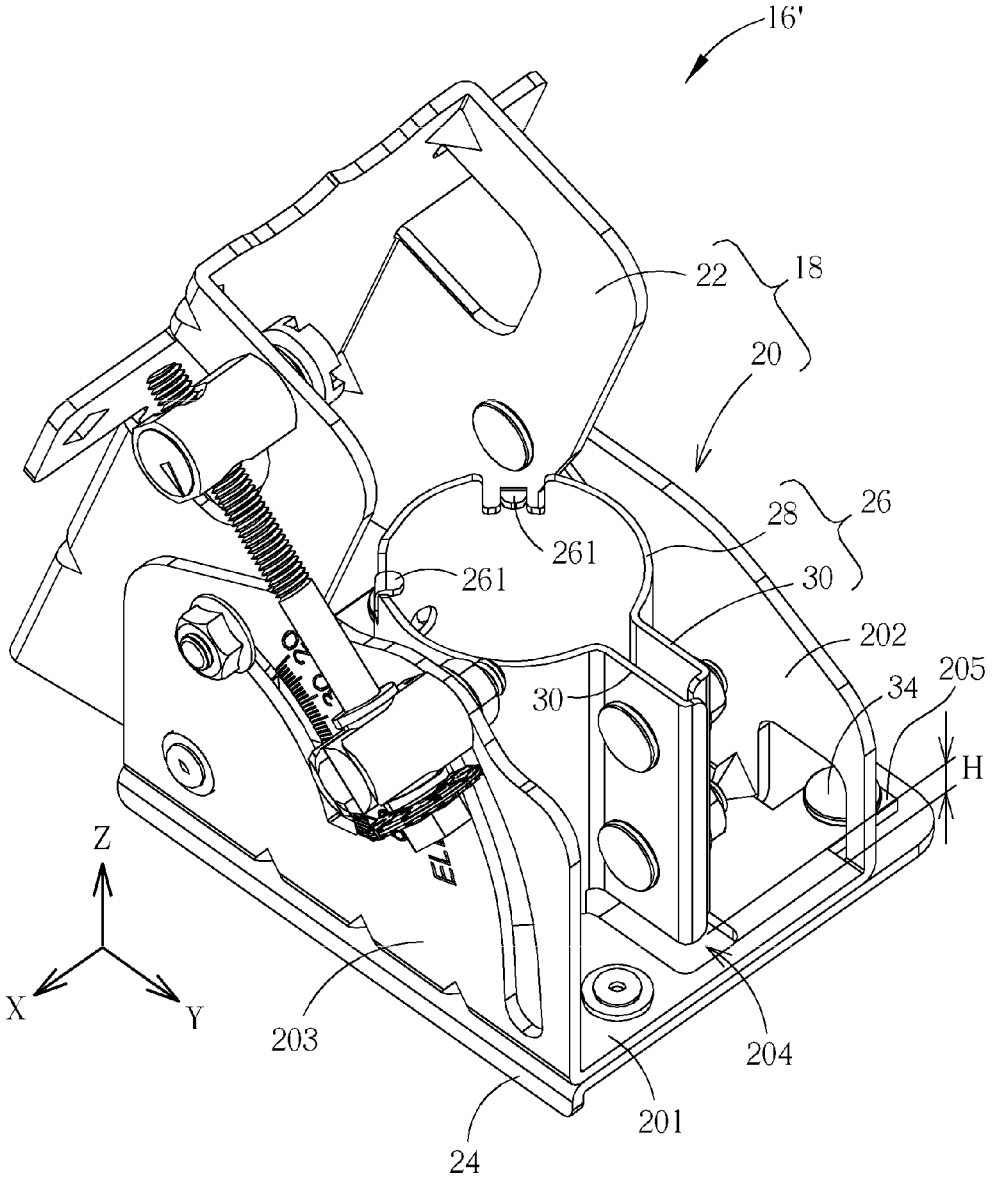
FIG. 6 and FIG. 7 are diagrams of an adjusting mechanism in different view angles according to a second embodiment of the present invention.
Figure 7:
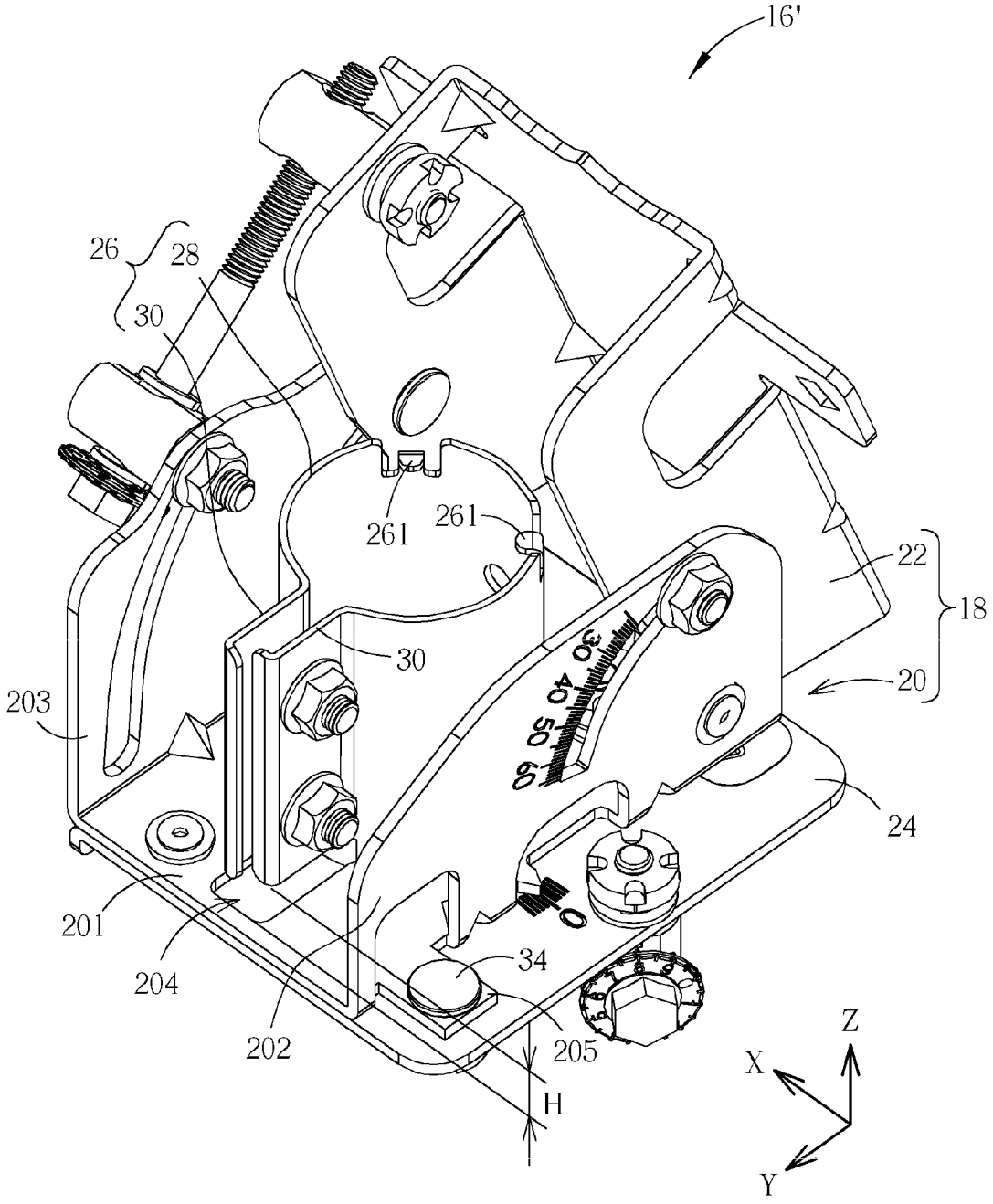

Please refer to FIG. 6 and FIG. 7. FIG. 6 and FIG. 7 are diagrams of an adjusting mechanism 16' in different view angles according to a second embodiment of the present invention. In the second embodiment, elements having the same numerals as ones of the first embodiment have the same structures and functions, and detail description is omitted herein for simplicity. Difference between the first embodiment and the second embodiment is that the fixing portion 205 of the adjusting mechanism 16' of the second embodiment can be an element whereon a lock hole is formed, and the conjunction portion 241 can be the same guiding slot as ones of the first embodiment. The adjusting mechanism 16' can further include a fixing component 34, such as a shoulder screw. The fixing component 34 can pierce through the guiding slot and the lock hole on the element, to constrain a movement of the base 20 relative to the foundation 24 along the third axial direction D3 (Z axis) for preventing the supporter 18 of the adjusting mechanism 16' from overturning due to an overload of the antenna module 12. In the second embodiment, the element whereon the lock hole is formed is reversed from the first lateral portion 202 of the base 20, and contacts the foundation 24 for being fixed with the foundation 24 by the fixing component 34. A reverse direction of the element is not limited to this embodiment, and depends on design demand.

Figure 8:
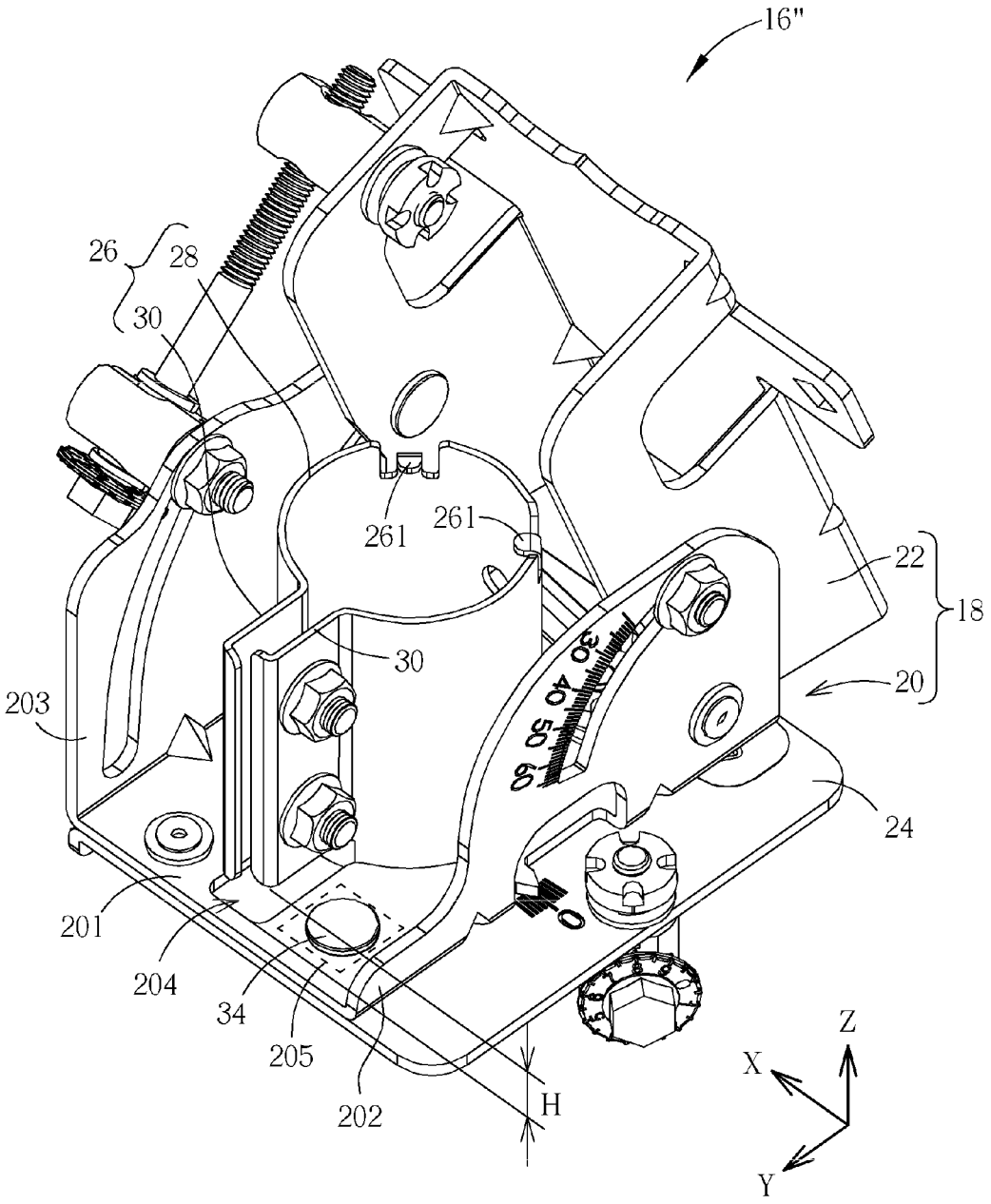
FIG. 8 is a diagram of an adjusting mechanism according to a third embodiment of the present invention.

Please refer to FIG. 8. FIG. 8 is a diagram of an adjusting mechanism 16" according to a third embodiment of the present invention. In the third embodiment, elements having the same numerals as the ones of the above-mentioned embodiments have the same structures and functions, and detail description is omitted herein for simplicity. Difference between the third embodiment and the above-mentioned embodiments is that the fixing portion 205 of the adjusting mechanism 16" is the element whereon the lock hole is formed, and the conjunction portion 241 is the same guiding slot as ones of the above-mentioned embodiments. For example, the lock hole can be formed on the surface of the bottom portion 201, which means the element with the lock hole can be a part of the bottom portion 201. The element can be fixed inside the guiding slot by the shoulder screw (the fixing component 34), so as to constrain the movement of the base 20 relative to the foundation 24 along the third axial direction D3 (Z axis).

In addition, superficial measure of the first lateral portion 202 of the adjusting mechanism 16" can be substantially smaller than superficial measure of the second lateral portion 203, and the base 20 has kept the sufficient structural strength, so as to expose a part of the connecting parts 30 of the clamper 26. Because the connecting parts 30 are accommodated between the first lateral portion 202 and the second lateral portion 203 of the base 20, a part of the first lateral portion 202 can be segmented for easy operation of the locking components and the connecting parts 30. As shown in FIG. 8, the connecting parts 30 of the clamper 26 accommodated inside the base 20 is exposed, and the user can conveniently utilizes a tool, such as a screw driver, to lock or to remove the locking components from the connecting parts 30.

Comparing to the prior art, the present invention disposes the clamper inside the base for reducing the structural height of the adjusting mechanism, so that the dimensions of the adjusting mechanism and the antenna system are decreased, and the manufacturing cost and the transportation cost can be decreased accordingly. The open hole can be formed on the bottom portion of the base, and the shape and the dimension of the open hole can correspond to the shape and the dimension of the clamper for easy assembly of the clamper and the base. In addition, the interval height between the connecting part and the foundation can prevent the bottom portion from being interfered with the connecting parts when the clamper is welded on the foundation, so the base of the present invention can rotate relative to the foundation unrestrainedly. The direction of the connecting parts of the present invention can be substantially parallel to the second axial direction, and the user can fix the locking components on the connecting parts (or remove the locking components from the connecting parts) through the gap between each connecting part and the adjacent lateral portion. Furthermore, the part of the lateral portion of the base can be segmented, so the user can utilize the screw driver to lock and to remove the locking components from the connecting parts due to difference of the superficial measures between the first lateral portion and the second lateral portion.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An adjusting mechanism comprising:

a supporter for supporting an antenna module, the supporter comprising:

a base, an open hole being formed on a bottom of the base, and the base comprising a fixing portion, the open hole comprising a first area and a second area; and a supporting component pivotably disposed on the base in a manner of surrounding a first axial direction, so as to adjust an elevation angle of the antenna module;

a foundation whereon the base is rotatably disposed in a manner of surrounding a third axial direction different from the first axial direction, so as to adjust an azimuth angle of the antenna module, a conjunction portion being disposed on a surface of the foundation, and the fixing portion being connected to the conjunction portion for preventing the base from rotating relative to the foundation; and a clamper fixed on the foundation, the clamper piercing through the open hole on the base and being partly accommodated between the base and the supporting component, the clamper comprising:

a circular body for clamping a tube, a dimension of the first area corresponding to a dimension of the circular body; and two connecting parts disposed on lateral surfaces of the circular body, the circular body being fixed on the tube via the connecting parts, a direction of each connecting part being substantially parallel to a second axial direction perpendicular to the first axial direction, and a dimension of the second area corresponding to dimensions of the two connecting parts.

2. The adjusting mechanism of claim 1, wherein the fixing portion is a hook, the conjunction portion is a guiding slot, the hook is slidably buckled inside the guiding slot, so as to constrain a movement of the base relative to the foundation along the third axial direction perpendicular to the first axial direction and the second axial direction.

3. The adjusting mechanism of claim 1, wherein the fixing portion is an element whereon a lock hole is formed, the conjunction portion is a guiding slot, the adjusting mechanism further comprises a fixing component, the fixing component pierces through the guiding slot and the lock hole on the element, so as to constrain a movement of the base relative to the foundation along the third axial direction perpendicular to the first axial direction and the second axial direction.

4. The adjusting mechanism of claim 1, wherein an interval height between a bottom of the connecting part and a surface of the foundation is substantially greater than a thickness of the base.

5. The adjusting mechanism of claim 1, wherein the base comprises a bottom portion, a first lateral portion and a second lateral portion, the first lateral portion and the second lateral portion are respectively disposed on two edges of the bottom portion and movably connected to the supporting component, and a part of the clamper is accommodated between the first lateral portion and the second lateral portion.

6. The adjusting mechanism of claim 5, wherein superficial measure of the first lateral portion is substantially smaller than superficial measure of the second lateral portion, so as to expose the connecting part of the clamper.

7. The adjusting mechanism of claim 1, wherein the adjusting mechanism comprises a plurality of rib structures, and the rib structures are respectively disposed on surfaces of the base, the supporting component and the foundation.

8. The adjusting mechanism of claim 1, wherein a contacting portion is disposed on a top of the clamper for constraining a movement of the clamper relative to the tube.

9. An antenna system comprising:

an antenna module;

a tube; and an adjusting mechanism disposed between the antenna module and the tube for adjusting angles of the antenna module relative to the tube, the adjusting mechanism comprising:

a supporter for supporting the antenna module, the supporter comprising:

a base, an open hole being formed on a bottom of the base, and the base comprising a fixing portion, the open hole comprising a first area and a second area; and a supporting component pivotably disposed on the base in a manner of surrounding a first axial direction, so as to adjust an elevation angle of the antenna module;

a foundation whereon the base is rotatably disposed in a manner of surrounding a third axial direction different from the first axial direction, so as to adjust an azimuth angle of the antenna module, a conjunction portion being disposed on a surface of the foundation, and the fixing portion being connected to the conjunction portion for preventing the base from rotating relative to the foundation; and a clamper fixed on the foundation, the clamper piercing through the open hole on the base and being partly accommodated between the base and the supporting component, the clamper comprising:

a circular body for clamping the tube, a dimension of the first area corresponding to a dimension of the circular body; and two connecting parts disposed on lateral surfaces of the circular body, the circular body being fixed on the tube via the connecting parts, a direction of each connecting part being substantially parallel to a second axial direction perpendicular to the first axial direction, and a dimension of the second area corresponding to dimensions of the two connecting parts.

10. The antenna system of claim 9, wherein the fixing portion is a hook, the conjunction portion is a guiding slot, the hook is slidably buckled inside the guiding slot, so as to constrain a movement of the base relative to the foundation along the third axial direction perpendicular to the first axial direction and the second axial direction.

11. The antenna system of claim 9, wherein the fixing portion is an element whereon a lock hole is formed, the conjunction portion is a guiding slot, the adjusting mechanism further comprises a fixing component, the fixing component pierces through the guiding slot and the lock hole on the element, so as to constrain a movement of the base relative to the foundation along the third axial direction perpendicular to the first axial direction and the second axial direction.

12. The antenna system of claim 9, wherein an interval height between a bottom of the connecting part and a surface of the foundation is substantially greater than a thickness of the base.

13. The antenna system of claim 9, wherein the base comprises a bottom portion, a first lateral portion and a second lateral portion, the first lateral portion and the second lateral portion are respectively disposed on two edges of the bottom portion and movably connected to the supporting component, and a part of the clamper is accommodated between the first lateral portion and the second lateral portion.

14. The antenna system of claim 13, wherein superficial measure of the first lateral portion is substantially smaller than superficial measure of the second lateral portion, so as to expose the connecting part of the clamper.

15. The antenna system of claim 9, wherein the adjusting mechanism comprises a plurality of rib structures, and the rib structures are respectively disposed on surfaces of the base, the supporting component and the foundation.

16. The antenna system of claim 9, wherein a contacting portion is disposed on a top of the clamper for constraining a movement of the clamper relative to the tube.

* * * * *